United States Patent [19]

Cooter

[11] 4,000,898

[45] Jan. 4, 1977

[54] HAND-HELD BASKETBALL GAME DEVICE

[76] Inventor: Terry A. Cooter, 1585 W. Dakota Ave., Denver, Colo. 80223

[22] Filed: Nov. 24, 1975

[21] Appl. No.: 634,833

[52] U.S. Cl. ..... 273/101; 273/105 R

[51] Int. Cl.[2] ..... A63B 65/12

[58] Field of Search ..... 273/1.5 R, 1.5 A, 85 R, 273/95 R, 96, 97 R, 98, 101, 105 R

[56] References Cited

UNITED STATES PATENTS

| | | | |
|---|---|---|---|
| 1,661,292 | 3/1928 | Klaus | 273/97 R |
| 1,695,937 | 12/1928 | Welch | 273/101 |
| 2,203,990 | 6/1940 | Heymer | 273/101 |
| 3,427,025 | 2/1969 | Procter | 273/1.5 R |
| 3,899,173 | 8/1975 | Zaris | 273/101 |
| 3,907,297 | 9/1975 | DiLeva | 273/97 R |

*Primary Examiner*—Richard J. Apley
*Assistant Examiner*—Vance Y. Hum
*Attorney, Agent, or Firm*—Ancel W. Lewis, Jr.

[57] ABSTRACT

A game device includes a paddle-like member having a main body portion with a flat playing surface and a grip portion that forms an extension of the main body portion. A plurality of ball-receiving pockets are recessed in the playing surface to position a ball at one of a plurality of selected launch points on the playing surface. An upright post supports a backboard and basket and is adjustably mounted on the main body portion member to dispose the basket at a selected position above the playing surface. In play action the ball is positioned at a selected one of the pockets and is launched toward the basket by a rotating movement of the hand about the wrist in a quick wrist action. The paddle-like member, post, backboard and basket are removably fastened to one another for ready assembly and disassembly of the device.

10 Claims, 6 Drawing Figures

HAND-HELD BASKETBALL GAME DEVICE

FIELD OF the INVENTION

This invention generally relates to devices used for toy, game or amusement purposes and more particularly to a novel miniature basketball game device.

BACKGROUND OF THE INVENTION

A number of devices in the game, toy or amusement category have heretofore been provided. Prior known game devices have used paddles to strike a ball to project the ball through the air such as with the game of ping pong and some have used a ball attached to a flexible line that is hit by a paddle. Some attempts have been made to provide game devices that are designed to some extent to simulate the game of basketball, but for the most part these have been of the ground or table supported variety with the ball being launched from a stationary surface toward the basket. Prior known attempts to launch the ball from a moving surface such as a paddle have not afforded launching from a plurality of fixed points and have not been constructed to afford any degree of flexibility for different skills of different players.

Accordingly, it is an object of the present invention to provide a relatively simple and relatively inexpensive game device that is hand-held providing a movable playing surface from which a ball is launched and simulating the game of basketball.

Another object of this invention is to provide a novel hand-held basketball game device which can be used for amusement to develop hand-eye coordination in a player, can be used to develop skills with practice and affords a high degree of competition between two or more players.

A further object of this invention is to provide a novel, miniature hand-held basketball game device that has a high degree of flexibility in the manner of play and scorekeeping.

Still a further object of this invention is to provide a game device having several relatively few and simple knockdown parts that can be placed in a relatively flat package and is suitable for relatively easy assembly and disassembly as well as having adjustability of the distance between the basket and playing surface from which the ball is launched, whereby the device can be adjusted for players of differing ages and skills.

Yet a further object of this invention is to provide a novel game device of the basketball variety characterized by having a paddle-like member that is gripped in the hand of a player, a basket positioned on a post above a playing surface, and a ball that is launched from one of a plurality of selected points on a moving playing surface toward the basket by a wrist action or like hand movement of the player.

SUMMARY OF THE INVENTION

A miniature hand-held basketball game utilizes a paddle-like member providing a movable playing surface and a post separable from the member that carries a basket at one end and is adjustably mounted on the paddle-like member to position the basket a selected distance from the playing surface. A plurality of pockets are recessed in the playing surface that position a ball at one of a plurality of positions on the playing surface from which the ball is launched toward the basket by a hand motion applied to the grip portion of the paddle-like member.

Other objects, advantages and capabilities of the present invention will become more apparent as the description proceeds taken in conjunction with the accompanying drawings, in which like parts have similar reference numerals and in which.

DESCRIPTION OF THE PREFERRED EMBODIMENTS

Figure 1:
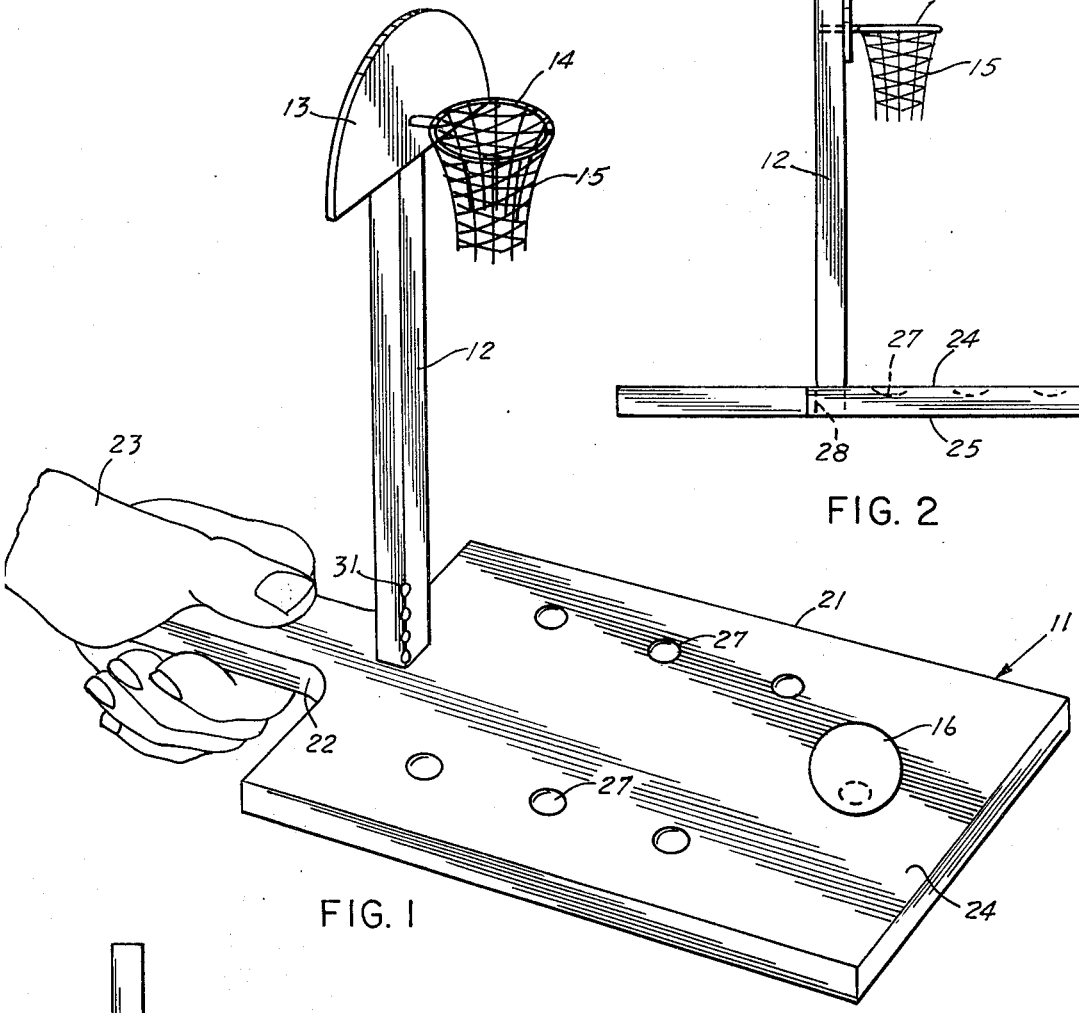
FIG. 1 is a perspective view of the hand-held basketball game device of the present invention shown as being gripped by the hand of a player, with a ball positioned in one of the pockets.
Figure 2:
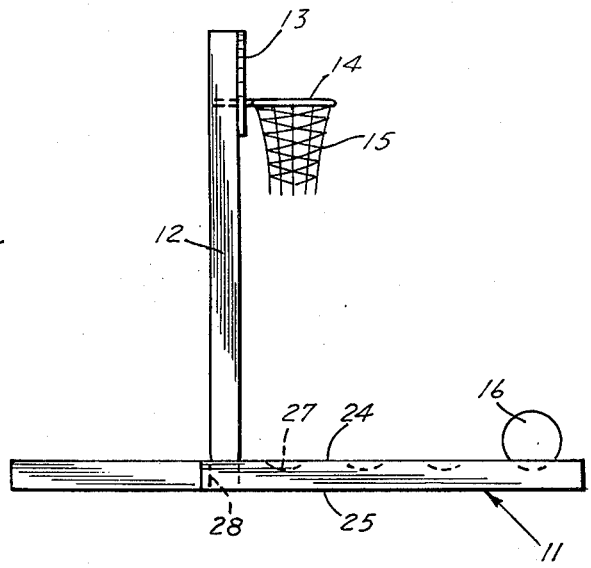
FIG. 2 is a side elevation view of the game device shown in FIG. 1.
Figure 3:
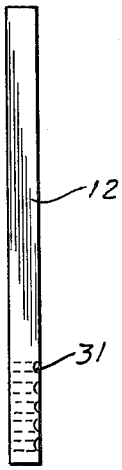
FIG. 3 is a side elevation view of the post only.
Figure 4:
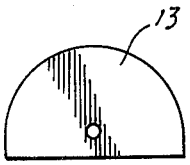
FIG. 4 is a front elevation view of the backboard only.
Figure 5:
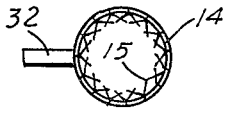
FIG. 5 is a top plan view of the basket only.
Figure 6:
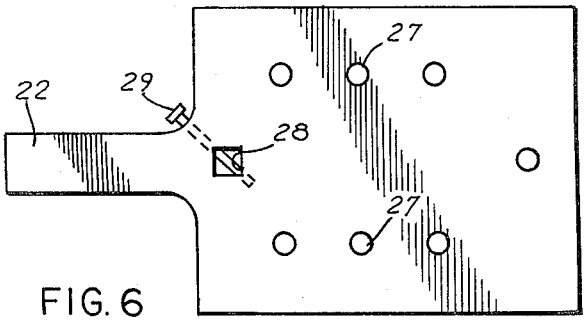
FIG. 6 is a top plan view of the paddle-like member only.

Referring now to the drawings, the game device shown in FIGS. 1 and 2 is assembled for play and this device in general includes a paddle or paddle-like member 11 having an upright post 12 mounted thereon. The post 12 carries a backboard 13 mounted on the free end thereof together with a basket comprised of a rim 14 mounted on the backboard and a net 15 on the rim. A ball 16 is shown in FIG. 2 as positioned for launch on member 11.

The paddle-like member 11 shown is constructed as a one-piece member having a flat main body portion 21 and a handle or grip portion 22 that forms an extension of the main body portion 21 and is gripped by the player in one hand as represented at 23. The shape of the bed portion 22 is generally oblong or rectangular with parallel, flat top and bottom surfaces designated by numerals 24 and 25, respectively, with the top surface 24 forming a playing surface. There are seven ball-receiving pockets 27 shown as recessed or formed in the top playing surface 24, three at spaced intervals fron one another on each side of a longitudinal center line passing longitudinally through the center of the member, and the seventh pocket being centered on the longitudinal center line of the base and located farthest from the post 12. These three pockets on each side of the center line form three sets of opposed pairs of pockets. These pockets 27 are generally semispherical in shape, and more specifically are less than a full semisphere in size and shape, and function to position the ball 16 for launching at one of a plurality of fixed points relative to the rim 14 and backboard 13. It is understood that there may be various arrangements of the pockets on the playing surface within the scope of the present invention.

A through hole 28 is formed in the bed portion adjacent the grip portion that is centered on a longitudinal center line of the main body portion into which one end of the post 12 is releasably or removably inserted. The cross section of the hole 28 is square, as is that of the post 12, and the relative sizes of each are selected to provide a close, slidefitting joint. The post 12 is held at one of a plurality of selected positions relative to the member 11 by means of providing a hole in the bed portion through which a pin 19 is inserted and a plurality of holes 31 at spaced intervals along the lower end of the post. These holes 31 are arranged diagonally in the post and in this way the height of the basket can be adjusted relative to the playing surface to adjust to the player's skill and for easier play by smaller children and the like.

Referring now to FIGS. 3 through 6, the post 12, rim 14, backboard 13, and member 11 are constructed as separate items or separate parts and in this way the device is readily assembled and disassembled to facilitate its being placed in a relatively flat package or envelope during shipment and then quickly and easily assembled, as shown in FIGS. 1 and 2, for play. The rim is shown to have a projecting pin portion 32 which inserts through a hole in the backboard and into a hole in the post in a tight-fitting friction relationship.

To assemble the parts shown, the pin 32 of the rim is inserted into a hole in the backboard and then into a hole in the post, the lower end of the post is inserted into the hole in the base, and the pin 29 is inserted into a related hole in the post.

OPERATION

In the play action, the ball 16 is inserted in one of the pockets, the grip portion 22 is gripped in one hand by a player as shown in FIG. 1, and by means of a flip or quick rotating wrist action of the hand about the wrist, the ball 16 is flipped or launched toward the basket, the object of the game being to place the ball through the basket, as is the case in the well-known sport or game of basketball.

There are several ways in which the game device can be played. For example, the ball may be placed in the pocket farthest from the basket and each player attempt to make a basket in ten flips. The number of baskets made in ten attempts would determine the winner. Another manner of play is to start at the farthest pocket and go around the playing surface, and once in each of the playing pockets the number of baskets would then determine the winner. This manner of play could be termed "Around the World". An added handicap would be to set a time limit such as fifteen seconds to make the circuit completely around the playing surface.

Although the present invention has been described with a certain degree of particularity, it is understood that the present disclosure has been made by way of example and that changes in details of structure may be made without departing from the spirit thereof.

What is claimed is:

1. A basketball game device comprising:

a movable paddle-like member having a grip portion adapted to be gripped by the hand of a player for hand movement, said member having a playing surface on one side with a plurality of ball-launching pockets at selected positions thereon and spaced from one another each pocket adapted to receive and position a ball at one of a plurality of selected points on the playing surface; and a post mounted upright on said member, said post having a basket spaced a selected distance from the playing surface by said post and arranged substantially parallel to said playing surface to locate said pockets at different locations relative to said basket whereby a ball positioned in one of said pockets is launched toward the basket by a movement of said member by a player gripping said grip portion.

2. A basketball game device as set forth in claim 1 wherein said paddle-like member has a main body portion of a generally oblong shape and said grip portion forms an extension of said main body portion, said main body portion having opposed parallel flat side surfaces with one side forming said playing surface.

3. A basketball game device as set forth in claim 2 wherein said pockets are arranged at spaced intervals relative to one another on each side of a longitudinal center line passing through the center of said main body portion and a pocket is centered on said center line located the farthest from said post.

4. A basketball game device as set forth in claim 2 wherein said post is centered on a longitudinal center line passing through the center of said main body portion and is positioned adjacent said grip portion at one end of said main body portion.

5. A basketball game device as set forth in claim 1 wherein said main body portion has an aperture into which one end of said post is removably inserted, said post being movable in and guided by said main body portion, and means to releasably hold the post at a selected position relative to said main body portion to position the basket at a selected position in relation to said playing surface.

6. A basketball game device as set forth in claim 1 wherein said post has a plurality of holes at spaced intervals from one end thereof and said releasable holding means for the post includes a pin inserted into a hole in said main body portion and into a selected one of said plurality of holes in said post.

7. A basketball game device as set forth in claim 1 including a backboard on said post with a rim mounted on said backboard and a net on said rim, said net and rim forming said basket.

8. A basketball game device as set forth in claim 7 wherein said rim has a pin portion adapted to releasably insert into holes in said backboard and said post in a friction fit for the assembly and disassembly of said rim, backboard and post.

9. A hand-held basketball game device comprising:

a movable hand-held paddle-like member having a main body portion and a grip portion forming a narrower extension of said main body portion, said main body portion having a flat playing surface with a plurality of ball-launching pockets disposed at selected positions and spaced from one another in said main body portion to position a ball at one of a plurality of selected fixed points on the main body portion;

a post having a backboard and a basket mounted thereon, said post having a series of vertically spaced apertures spaced from the end opposite the basket, said apertures adapted to aline with an aperture in the main body portion through which a pin is inserted to position the basket at a selected distance from the playing surface and arranged substantially parallel to said playing surface to locate said pockets at different locations relative to said basket, said backboard and basket being releasably mounted on said post whereby a ball positioned at one of said pockets is launched toward the rim by a player gripping the grip portion and movement of said member by using a wrist movement.

10. A hand-held basketball game device comprising:

a hand-held paddle-like member having a generally oblong-shaped main body portion and a grip portion forming a narrowed extension of said main body portion, said main body portion having opposed flat side surfaces with one of said side surfaces forming a playing surface, there being a plurality of pockets arranged at spaced intervals relative to one another on each side of a longitudinal center line passing through the center of said main body portion and a pocket centered on said center line located the farthest from said post to position a ball at one of a plurality of selected points on the main body portion;

an upright post having a backboard and basket at one end removably mounted on said paddle-like member, said post being centered on a longitudinal center line passing through the center of said main body portion and positioned adjacent said grip portion at one end of said main body portion, said post having a series of apertures at spaced intervals from the end opposite the backboard adapted to aline with an aperture in the main body portion through which a pin member is inserted to position the basket at a selected position relative to the playing surface of said main body portion, said basket including a rim and a net on the rim, said rim having a pin inserted through a hole in the backboard into said post in a friction joint for ready assembly and disassembly of said backboard and rim from said post whereby a ball positioned at one of said pockets is launched toward the rim by a player gripping the handle portion and using a quick wrist movement.

* * * * *